US010653579B1

(12) United States Patent
Christofides

(10) Patent No.: US 10,653,579 B1
(45) Date of Patent: May 19, 2020

(54) MOTORIZED LIFE CANE

(71) Applicant: Mario Christofides, Gulfport, MS (US)

(72) Inventor: Mario Christofides, Gulfport, MS (US)

( * ) Notice: Subject to any disclaimer, the term of this patent is extended or adjusted under 35 U.S.C. 154(b) by 177 days.

(21) Appl. No.: 16/056,997

(22) Filed: Aug. 7, 2018

(51) Int. Cl.
*A61H 3/02* (2006.01)
*A45B 9/02* (2006.01)
*A45B 9/00* (2006.01)

(52) U.S. Cl.
CPC ..... *A61H 3/0244* (2013.01); *A45B 9/02* (2013.01); *A45B 2009/007* (2013.01); *A61H 2003/0205* (2013.01)

(58) Field of Classification Search
CPC .... A45B 3/00; A45B 3/02; A45B 3/04; A45B 3/12; A45B 9/02; A45B 2009/007
USPC ..... 135/65, 66, 69, 75, 77, 80, 910
See application file for complete search history.

(56) References Cited

U.S. PATENT DOCUMENTS 2,508,104 A * 5/1950 Dickensheets ..... A45B 3/00 135/66
3,289,685 A * 12/1966 McCall Parker .... A61H 3/0288 135/65
4,062,371 A * 12/1977 Bolen ..... F21L 4/08 135/66
5,282,486 A * 2/1994 Hoover ..... A61H 3/02 135/69
5,390,687 A * 2/1995 Tsai ..... A61H 3/02 135/65
5,533,536 A * 7/1996 Hong ..... A61H 3/02 135/65
7,918,237 B1 * 4/2011 Kuo ..... A61H 3/02 135/65
9,038,647 B1 * 5/2015 Scott ..... A61H 3/02 135/73
9,364,384 B2 * 6/2016 Van Den Driesche .. A61H 3/02
9,591,902 B1 * 3/2017 Hyde ..... A61H 3/00
2005/0103373 A1 * 5/2005 Heiss ..... A45B 9/00 135/100
2009/0038664 A1 * 2/2009 Juslin ..... A45B 3/00 135/66
2011/0061698 A1 * 3/2011 Iwata ..... A45B 9/00 135/69
2011/0220161 A1 * 9/2011 Jordan ..... A45B 3/04 135/66
2012/0160286 A1 * 6/2012 Ban ..... A45B 3/00 135/75
2012/0167933 A1 * 7/2012 Vegvary ..... A61H 3/02 135/69

* cited by examiner

*Primary Examiner* — Joshua E Rodden

(57) ABSTRACT

A motorized walking cane operated by a rechargeable battery powered linear actuator that assists a person to rise from a sitting position to a standing position and to lower from a standing position to a sitting position. The speed of the linear actuator can be adjusted with the use of a variable speed controller. The motorized lift cane can include an interface for receiving additional accessories.

3 Claims, 9 Drawing Sheets

100

MOTORIZED LIFE CANE

BACKGROUND OF THE INVENTION

The following is a tabulation of some prior art that presently appears relevant:

| Pat. No. | Kind Code | U.S. Patents Issue Date | Patentee |
|---|---|---|---|
| 4,562,850 | | 1986 Jan. 07 | Earley et al. |
| 7,356,858 | B2 | 2008 Apr. 15 | Summers |
| 6,834,660 | B1 | 2004 Dec. 28 | Van Wart, Jr. |

This invention relates to mechanical mobility aid devices, such as walking canes, or the like.

Various types of canes are known in the prior art. However, what has been needed is a cane with lifting capabilities. Many attempts have been made in the prior art to deal with ambulatory assistance devices for individuals with mobility problems.

In the past individuals needing assistance in rising from a seated position to a standing position had to depend upon human or prior art mechanical support. Prior art addressed individuals that needed extensive assistance to move from sitting to standing positions. Prior art did not address individuals that are mobile and only need minimal assistance to arise from a seated position to a standing position.

Prior art lift devices were bulky and required Nursing or Therapy personnel to operate them.

The most pertinent prior art patents for walking canes with uprisal device may be found in U.S. Pat. No. 4,562,850 to Earley et al., and in U.S. Pat. No. 6,834,660 B1 to Van Wart, Jr.

The most pertinent prior art patent for sit to stand support apparatus may be found in U.S. Pat. No. 7,356,858 B2 to Summers.

The Earley et al. patent sets forth a walking cane with a flange or disk mounted upon the shaft of the cane to assist the user in rising from a seated position to a standing position. The user has to assert physical force to manually rise from the seated position to the standing position. For some users this would be a very difficult task.

The Van Wart Jr. patent sets forth a walking cane with an upper handle attached to the upper end of the cane shaft and a second lower handle attached to the shaft below the upper handle of the cane to assist the user in rising from a seated position to a standing position. The user has to assert physical force to manually rise from the seated position to the standing position. For some users this would be a very difficult task.

The Summers patent sets forth a sit to stand support apparatus that lifts an individual, who is usually limited in mobility and strength, from a seated position to a standing position. It requires the assistance of another person, usually a licensed person in the likes of a nursing assistant or a nurse, to operate the apparatus. The apparatus does not provide mobility aid ability such as walking.

What is needed is a mechanical mobility aid device, such as a walking cane or the like, with lift capabilities to assist an individual who is mobile to rise from a seated position to a standing position, and allow the individual to more easily move between locations and conduct their daily lives without assistance from care workers.

SUMMARY OF THE INVENTION

The general purpose of the present motorized lift cane, described subsequently in greater detail, is to provide a cane with lift capabilities that result in a motorized lift cane which is not anticipated, rendered obvious, suggested, or even implied by prior art, either alone or in combination thereof.

One embodiment of the invention comprises a motorized lift cane for raising an individual from a seated position to a standing position using a battery powered linear actuator, a switch means, a variable speed control means, a battery compartment with a rechargeable battery, an upper shaft, a lower shaft, a tip, a battery charger connector, a low battery indicator light, and a full charge indicator light.

Another embodiment of the motorized lift cane comprises of a power pack means attached to the front of the cane that can include a rechargeable battery, a variable speed control means, and a wireless camera to allow a person in possession of the walking aid to communicate live through a wireless communication device with another person for assistance over a network communication carrier.

In yet another embodiment of the present invention, the motorized lift cane comprises the ability to mechanically adjust the height of the cane thereby easily accommodating people of different heights.

In accordance with the foregoing it is an object of the invention therefore to provide a mobility aid device such as a cane or the like that includes a lift means to assist the user in arising from a seated position to a standing position or to lower from a standing position to a seated position and to mechanically adjust the height of the cane or the like.

Other objects and advantages of the invention will become apparent by reference to the description and the accompanying drawings.

DETAILED DESCRIPTION OF THE INVENTION

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations below are exemplary implementations provided to enable persons skilled in the art to practice the disclosure and are not intended to limit the scope of the appended claims.

Furthermore, there is no intention to be bound by any expressed or implied theory presented in the preceding technical field, background, brief summary or the following detailed description. Reference will now be made in detail to implementations of the invention, examples of which are illustrated in the accompanying drawings.

Figure 1:
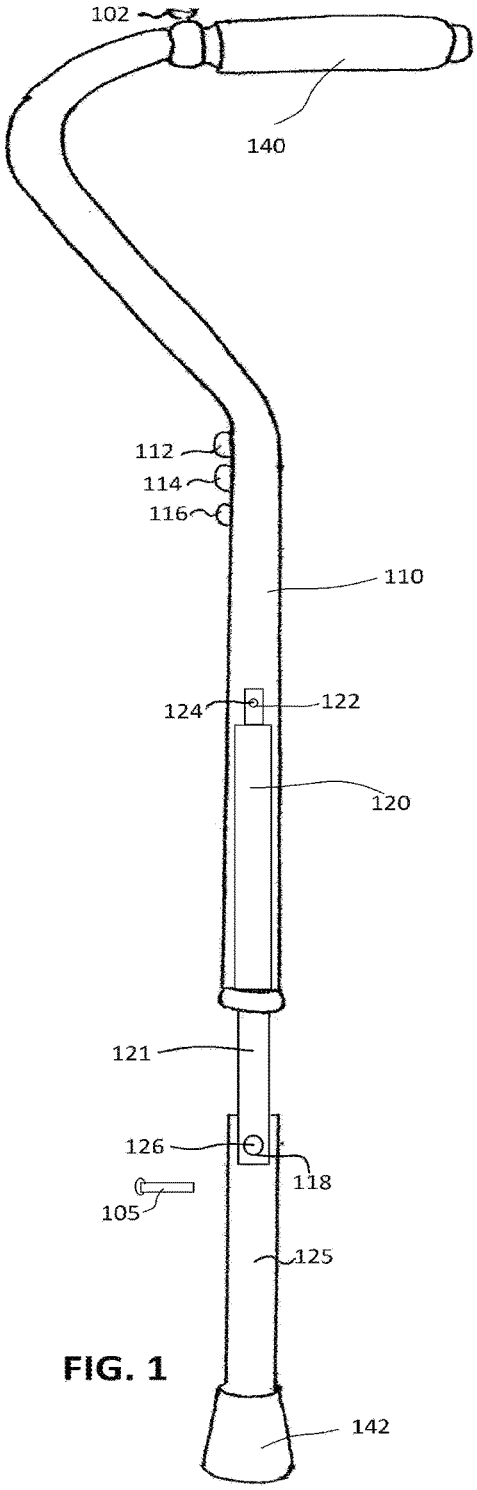
FIG. 1 is a conceptual diagram illustrating the top, side, and bottom view of the motorized lift cane.

FIG. 1 illustrates an embodiment of a motorized lift cane 100 that comprises of an upper shaft 110, an upper shaft pin hole 122, a lower shaft 125, a lower shaft pin hole 118, a hand-grip 140, a switch 102, a linear actuator 120, a low battery indicator light 112, a fully charged battery indicator light 114, a battery charger connector 116, and a tip 142. The tip 142 is generally constructed in such a way that it fits over the end of the lower shaft 125 or is inserted into a hole of the lower shaft 125. The tip 142 may be constructed of a material that can provide stability for the motorized lift cane 100 and prevent it from sliding on smooth surfaces. For instance rubber or silicone could be used as a non-limiting example. The illustrated tip 142 slides over the end of the lower shaft 125 to introduce friction to a surface, thus helping to prevent the motorized lift cane 100 from sliding during use. The motorized lift cane 100 may be constructed out of steel, aluminum, or any combination materials thereof. In the illustrated embodiment the lower part 121 of the linear actuator 120 is attached with a pin 105 through the lower shaft pin hole 118 to the lower shaft 125 of the motorized lift cane 100. The upper part 124 of the linear actuator 120 is attached with a pin 105 through the upper shaft pin hole 122 to the upper shaft 110 of the motorized lift cane.

In practice, in one embodiment the switch 102 is pushed to trigger the linear actuator 120 to extend or retract, consequently causing the motorized lift cane 100 to rise or lower. In another embodiment, another switch may be provided that allows for a variable speed control of the linear actuator 120. In yet another embodiment a three position toggled pressure switch may be provided which allows a first position that causes the linear actuator 120 to rotate in one direction, a second neutral position, and a third position that causes the linear actuator 120 to rotate in the other direction.

In the illustrated embodiment the low battery indicator light 112 alerts the user when the battery needs charged. The battery charger connector 116 connects to a battery charger (not shown), and the fully charged battery indicator light 114 alerts the user when the battery is fully charged.

Figure 5:
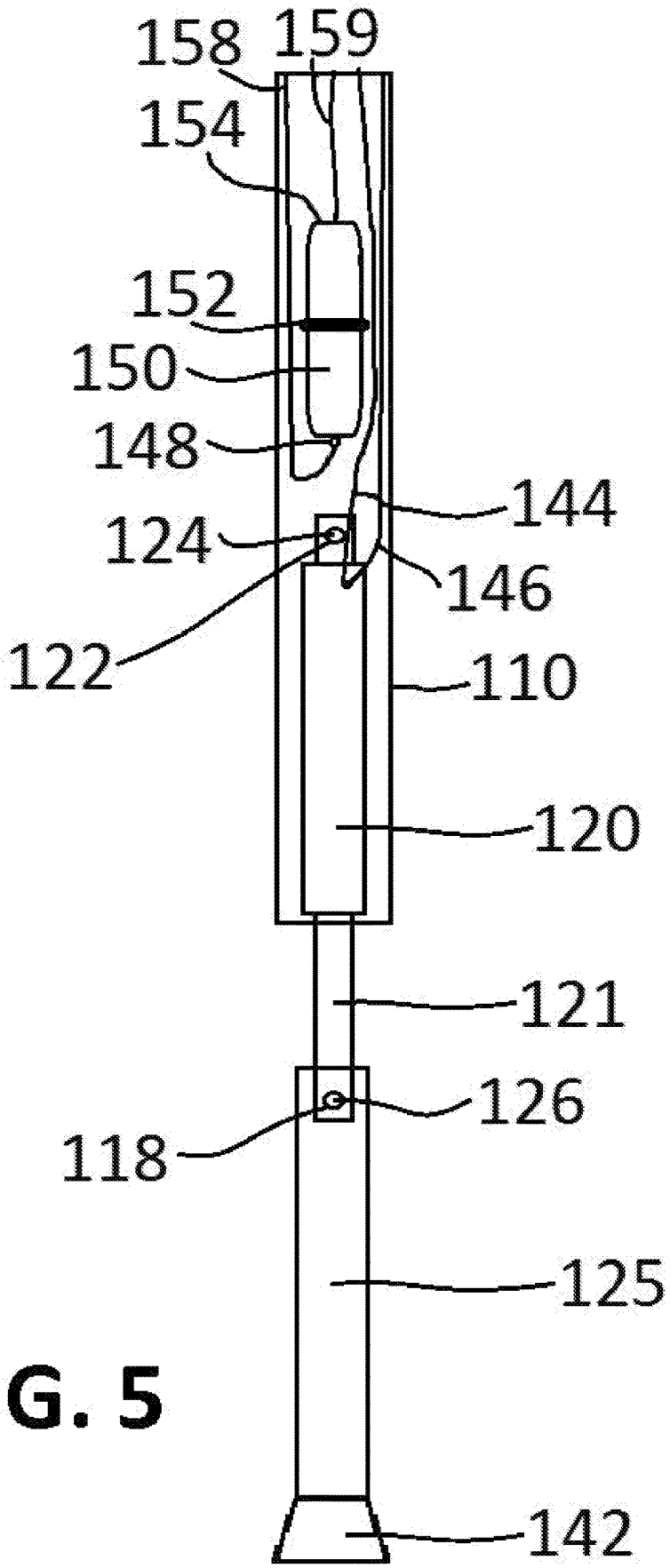
FIG. 5 is an exploded view of the motorized lift cane 100 illustrated in FIG. 1 and presents further detail of the attachments of the linear actuator means and the battery embodiment means.
Figure 6:
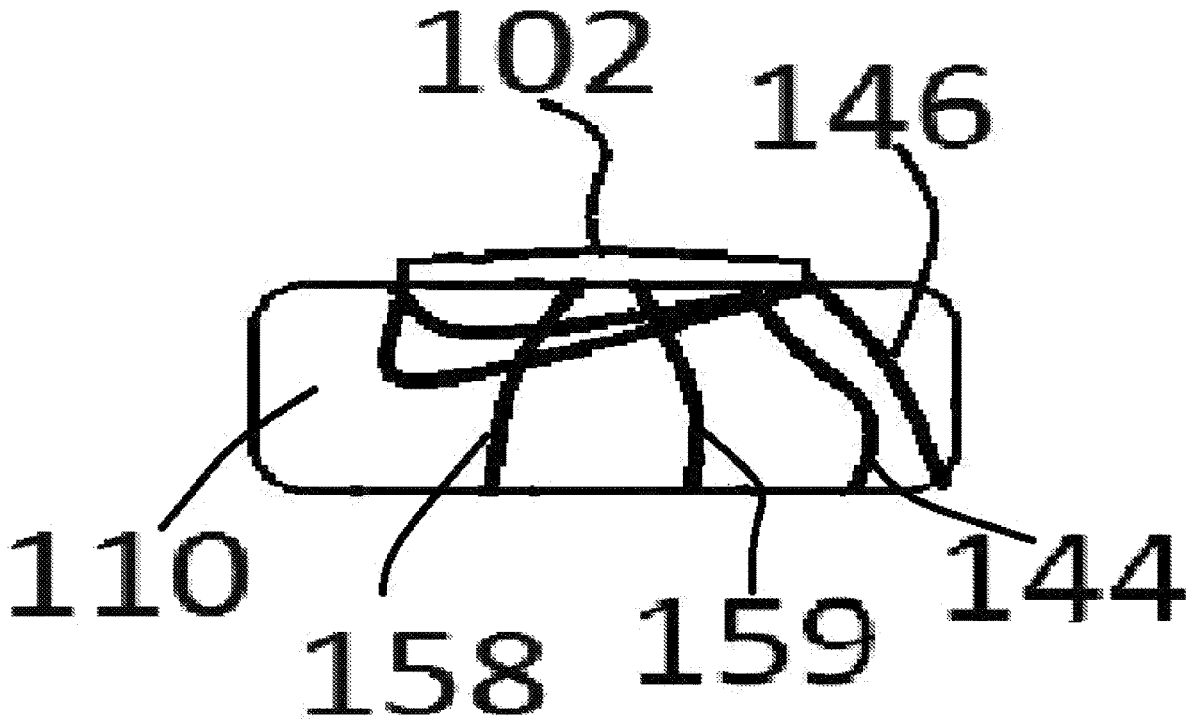
FIG. 6 is an exploded view of the switch means 102 embodiment in FIG. 1 showing the wiring arrangement.

FIG. 5 is an exploded view of the motorized lift cane 100 illustrated in FIG. 1 and presents further details of the battery fastening means 152, the battery 150, the positive battery connector 148, the negative battery connector 154, the linear actuator 120 placement, and the wiring arrangement. Positive wiring 146 and negative wiring 144 are coming out of the linear actuator 120 and connecting to the switch in FIG. 6. Positive wiring 158 and negative wiring 159 are connecting from the battery terminals to the switch in FIG. 6.

Figure 2:
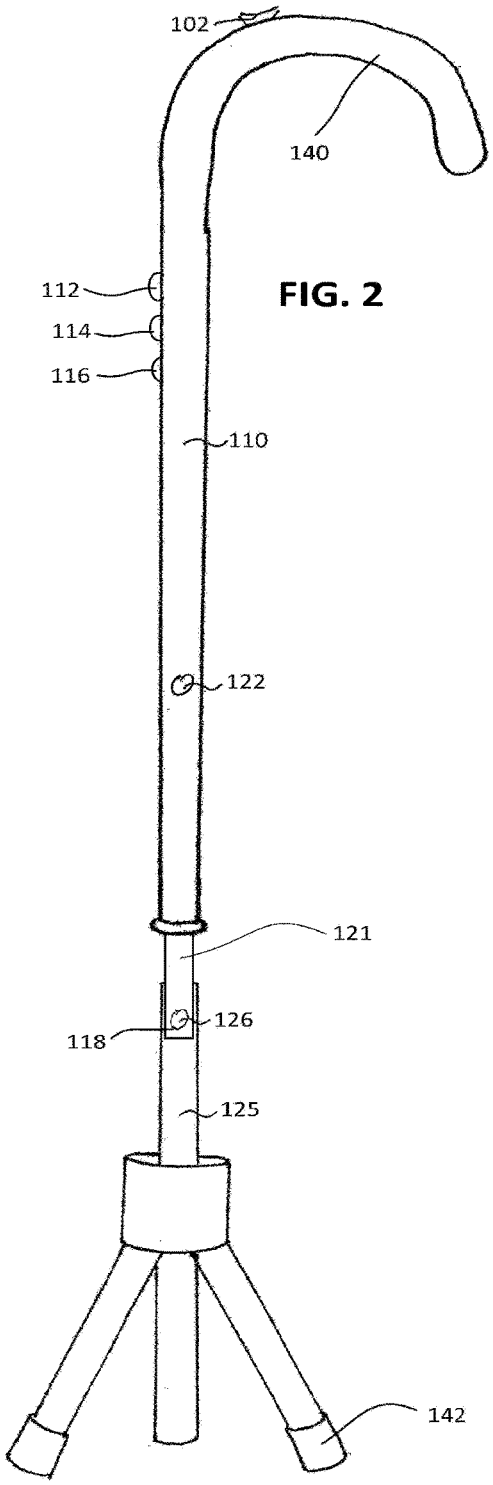
FIG. 2 is an alternative embodiment of the motorized lift cane illustrating the top, side, and bottom view.
Figure 3:
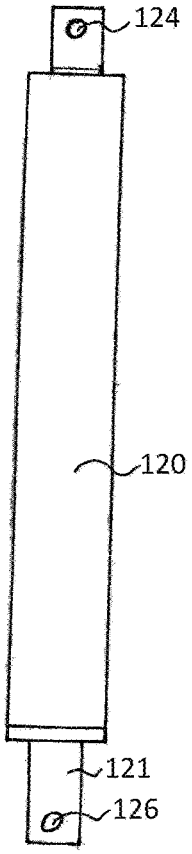
FIG. 3 is an exemplary embodiment of the top, side, and bottom view of the linear actuator means in a retracted position.
Figure 4:
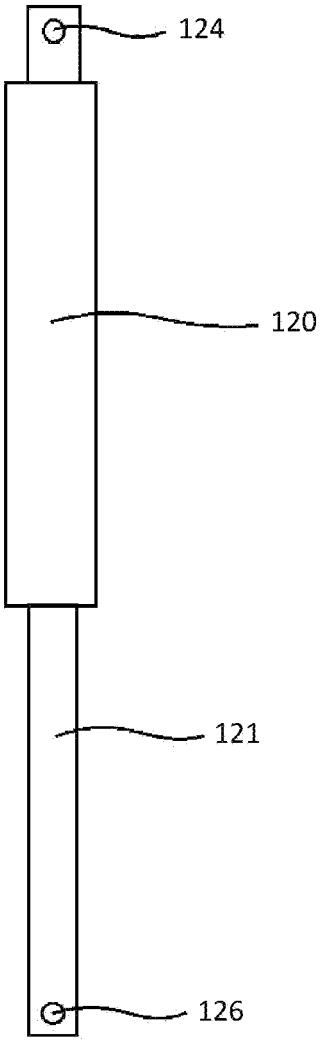
FIG. 4 is an exemplary embodiment of the top, side, and bottom view of the linear actuator means in an extended position.
Figure 7:
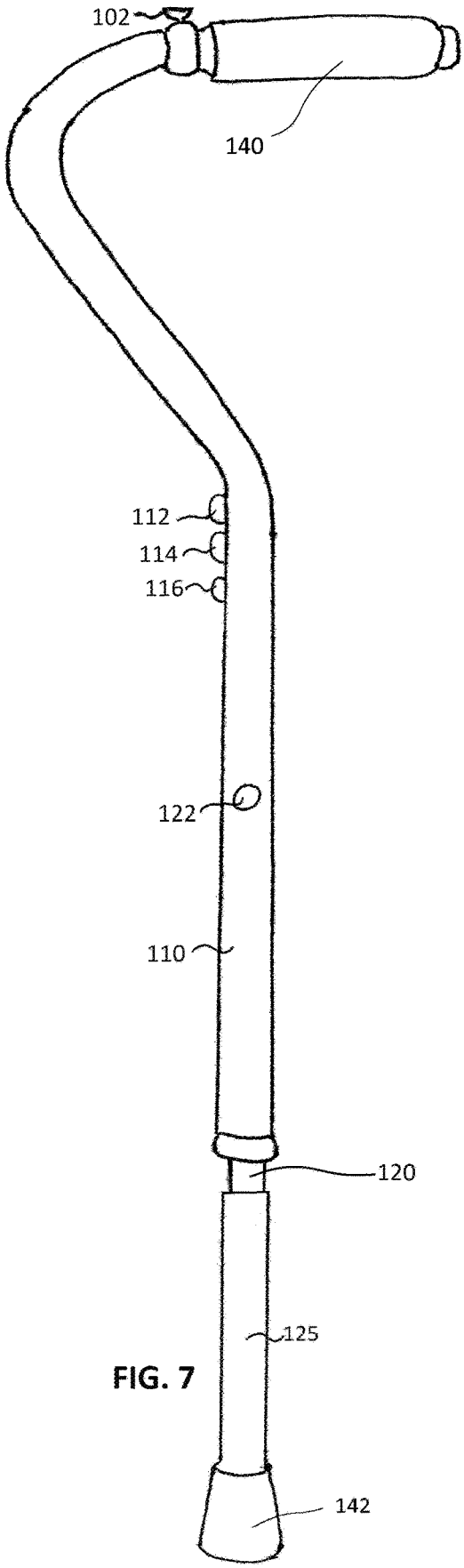
FIGS. 7-8 are exemplary embodiments of the motorized lift cane 100 in FIG. 1 and FIG. 2 in a retracted position.
Figure 8:
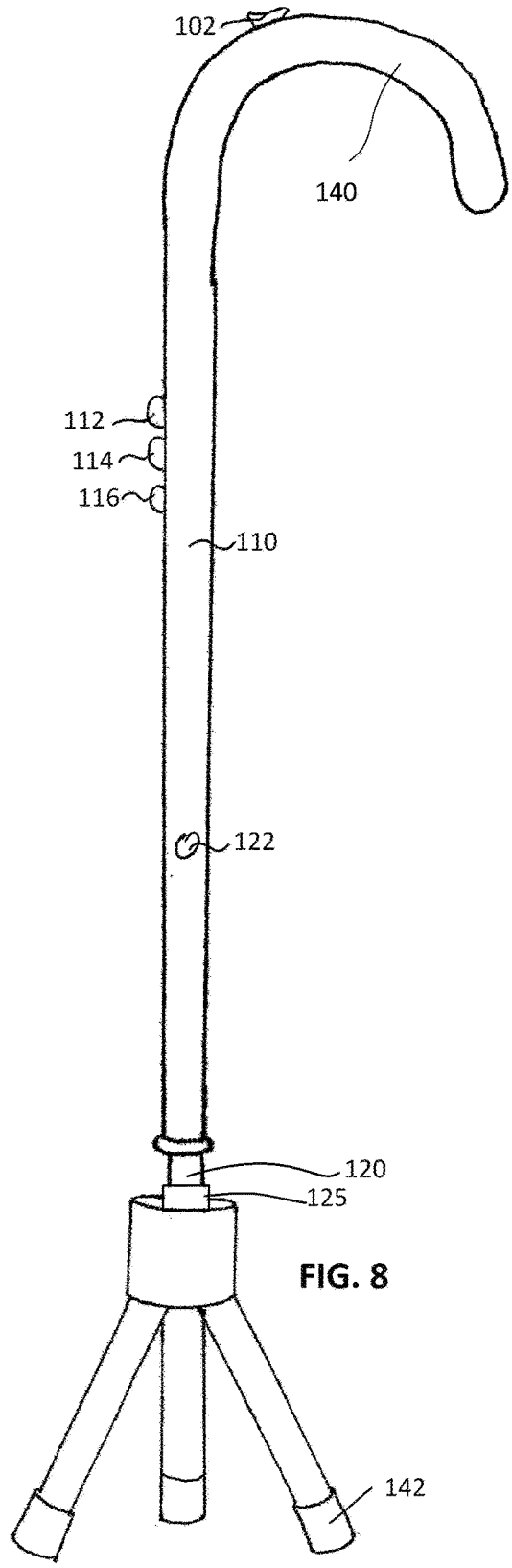
Figure 9:
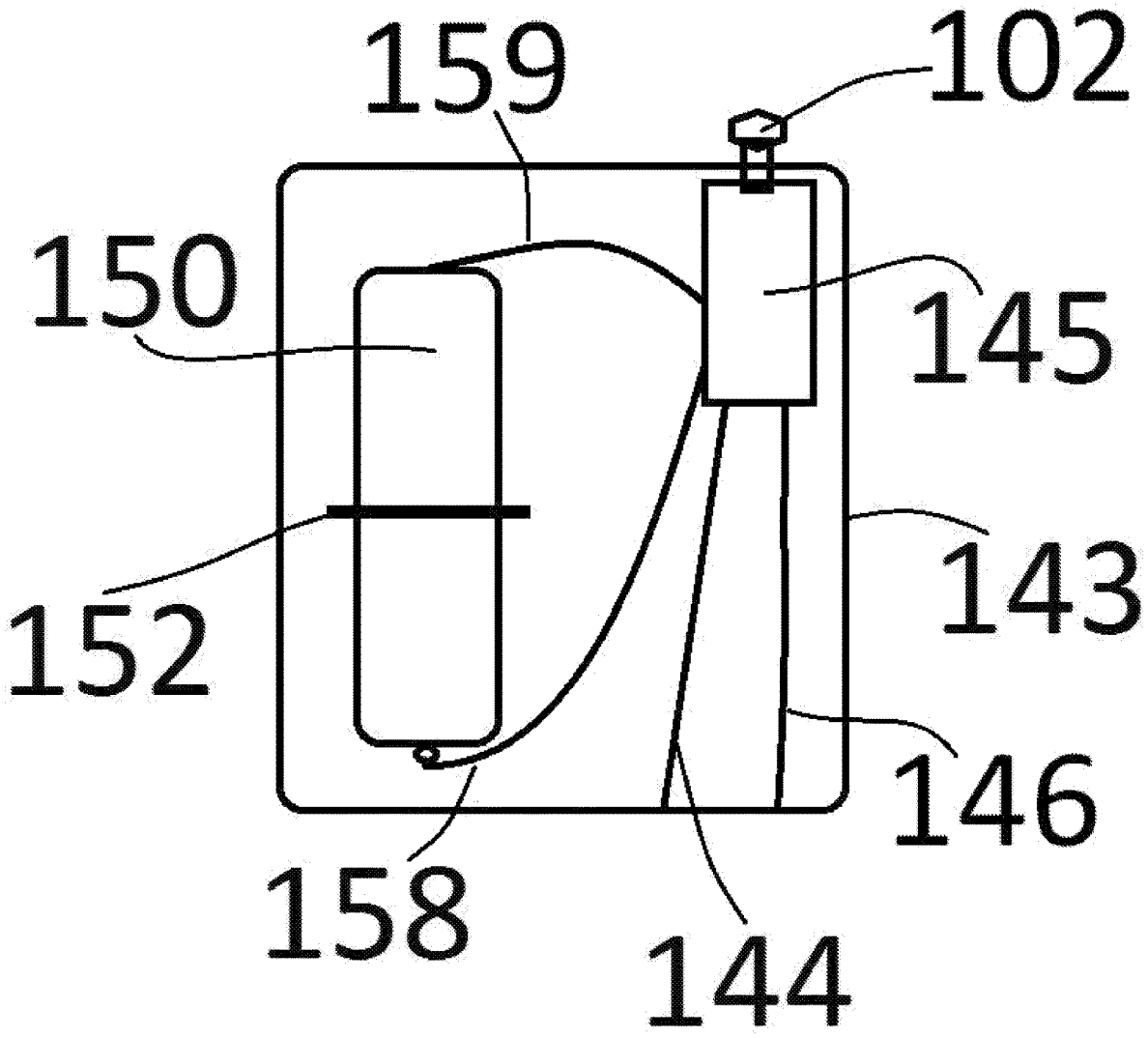
FIG. 9 is an exemplary embodiment of the power pack means 143 that may be used on the front surface of the motorized lift cane in FIG. 1.
Figure 10:
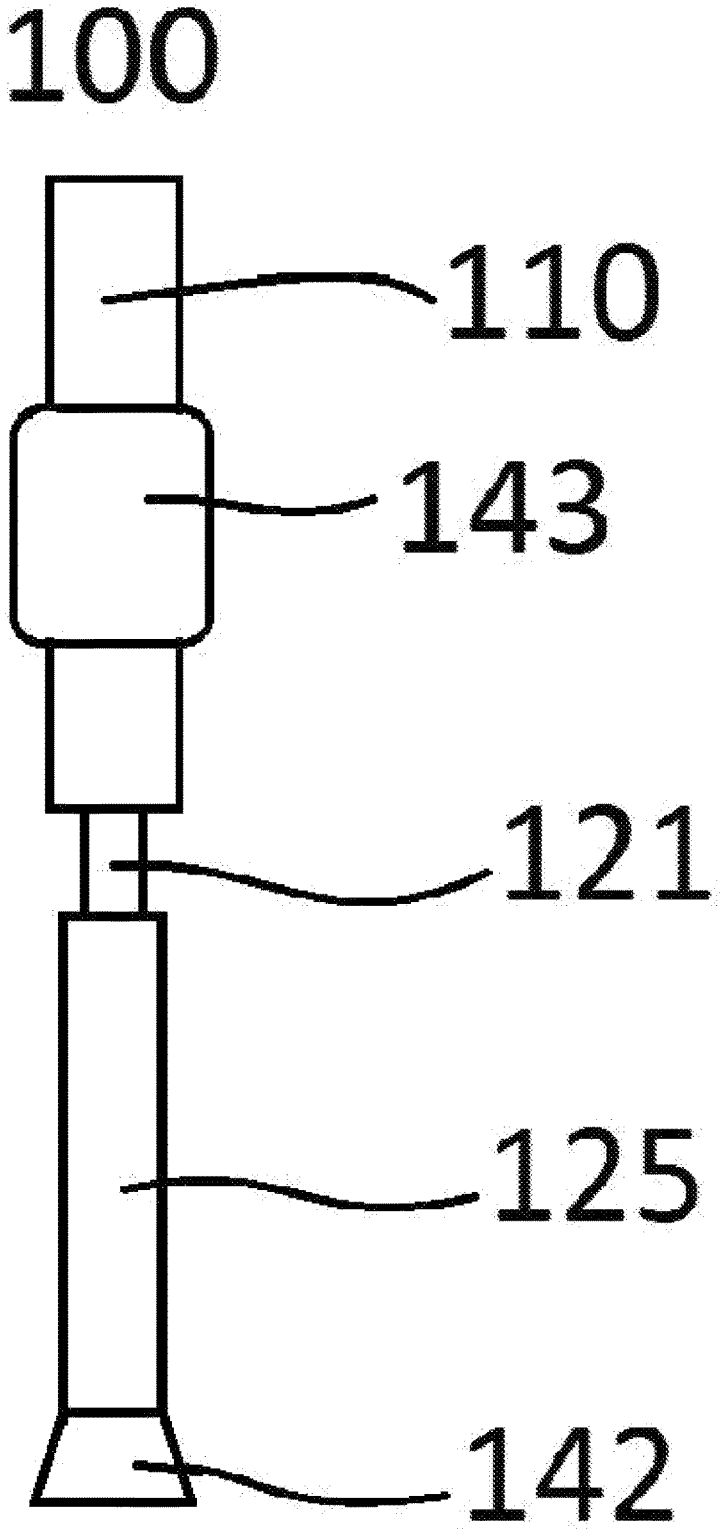
FIG. 10 is an exemplary embodiment of the motorized lift cane 100 in FIG. 1 in a frontal view with the power pack 143 attached.

FIGS. 7-8 are exemplary embodiments of the motorized lift cane 100 in FIG. 1 and FIG. 2 showing the lower part of the linear actuator means illustrated in FIG. 3 in a retracted position. FIG. 9 is an exemplary embodiment of the power pack means 143 that may be used on the front surface of the motorized lift cane 100 in FIG. 1 and presents further details of the switch 102 being connected to a variable speed control circuit board 145, along with the battery's 150 positive wiring 158 and negative wiring 159 and the linear actuator's 120 positive wiring 146 and negative wiring 144 connections to the same circuit board 145.

Figure 11:
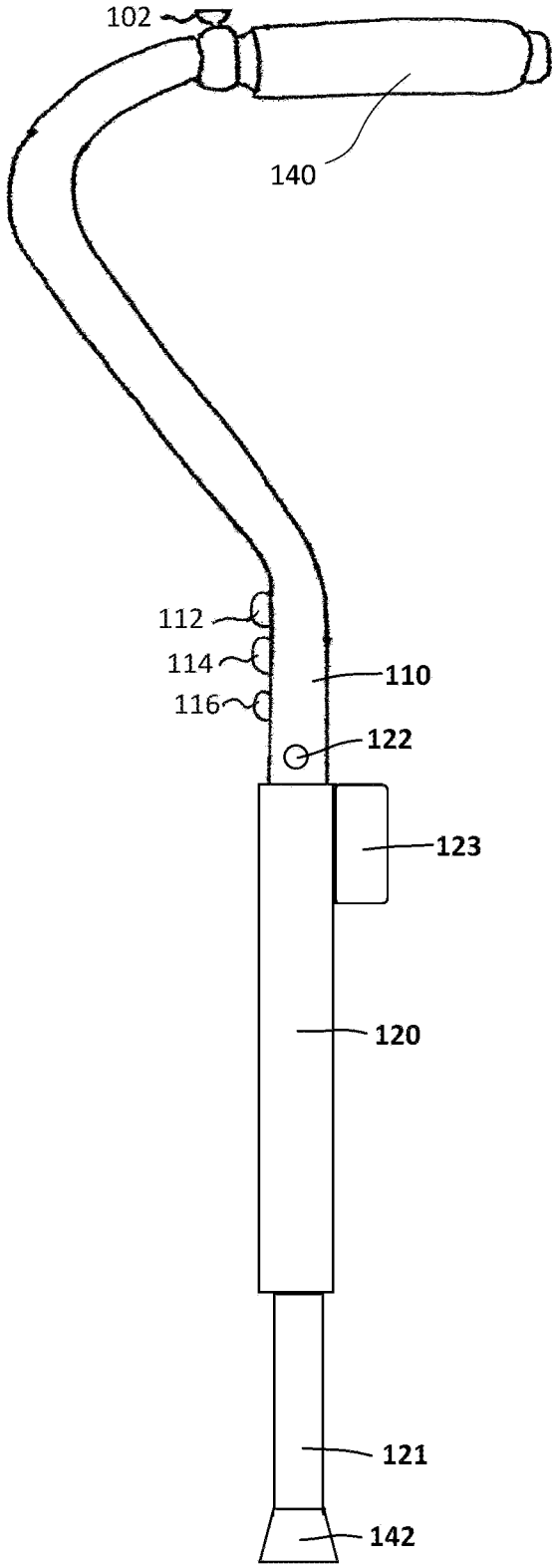
FIG. 11-12 are alternative embodiments of the motorized lift cane illustrating the top, side, and bottom view.

FIG. 11 is yet another embodiment of the motorized lift cane 100 with the linear actuator 120 externally attached to the upper shaft 110 of the motorized lift cane 100. This embodiment of the linear actuator 120 has the motor 123 attached on the outside of the linear actuator 120. The lower part 121 of the linear actuator 120 acts as the lower shaft of the motorized lift cane.

Figure 12:
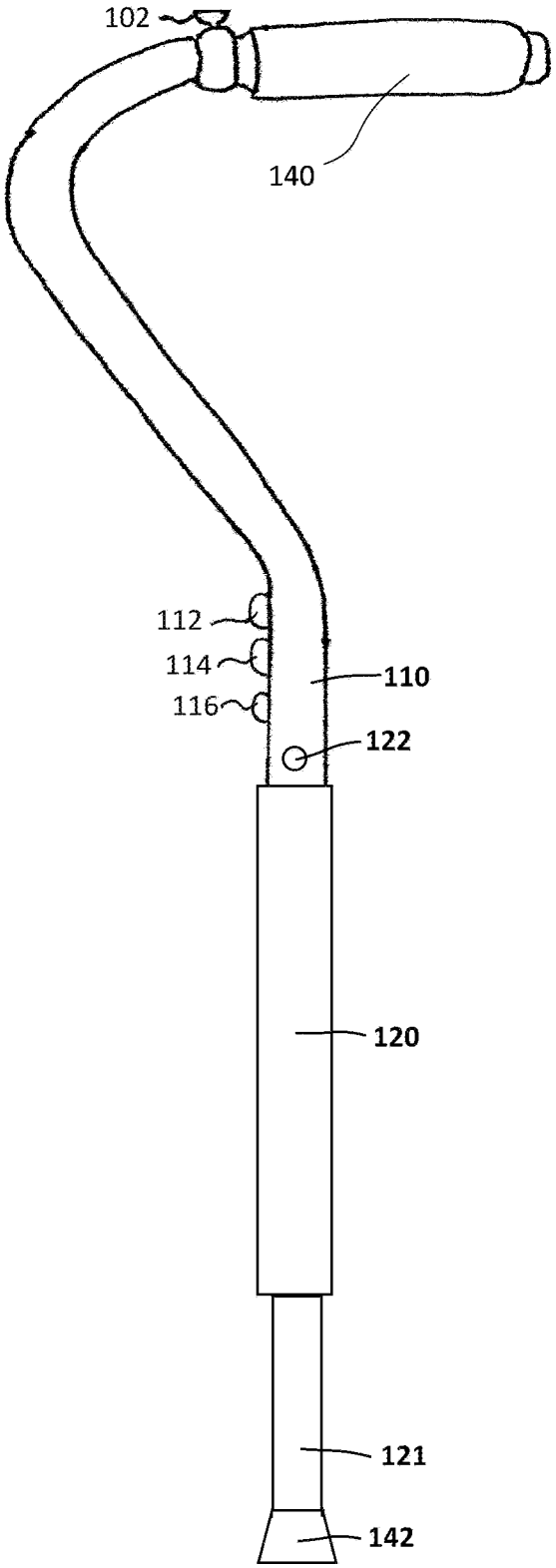

FIG. 12 is yet another embodiment of the motorized lift cane 100 with the linear actuator 120 externally attached to the upper shaft 110 of the motorized lift cane 100. The lower part 121 of the linear actuator 120 acts as the lower shaft of the motorized lift cane.

While the invention has been described in terms of a cane, it is readily seen that the invention may be utilized in other mobility aid devices.

What I claim is:

1. A motorized lift cane used to aid a mobile person to rise from a sitting position to a standing position and to lower said person from the standing position to the sitting position, said motorized lift cane comprising:

a) a cylindrical hollow upper shaft means and a cylindrical hollow lower shaft means, a diameter of said cylindrical hollow lower shaft means being smaller than a diameter of said cylindrical hollow upper shaft means and being partially slidably contained therein, b) said upper shaft means including a handle on an upper shaft end, a switch means secured to said upper shaft means along a top closer to the handle, a rechargeable battery means secured within the said upper shaft or externally to the said upper shaft, a low battery light indicator means, a fully charged battery light indicator means, a battery charger connector means, and a battery powered linear actuator means connecting said upper shaft means and said lower shaft means, c) an electrical conductor means extending between said battery means, said switch means, said low battery light indicator means, said fully charged battery light indicator means, said battery charger connector means, and said linear actuator means for operation of said linear actuator means, d) said lower shaft means including an attached tip, e) said linear actuator means comprises a tubular upper cover section and a tubular lower cover section, said tubular upper cover section attached to said cylindrical hollow upper shaft means and said tubular lower cover section attached to said cylindrical hollow lower shaft means.

2. The motorized lift cane in accordance with claim 1 wherein said switch means is a reversible switch whereby it controls an up and down position of said linear actuator means.

3. The motorized lift cane in accordance with claim 1 wherein said upper cover section attaches externally to the said cylindrical hollow upper shaft means and said linear actuator tubular lower cover section means acts as the lower shaft means; whereby said lower cover section includes the attached tip.

* * * * *